United States Patent [19]

Rossi

[11] 4,117,647

[45] Oct. 3, 1978

[54] FLEXIBLE POUCH, FORMING, FILLING AND SEALING MACHINE

[76] Inventor: Alfred F. Rossi, 503 Old Woods Rd., Wyckoff, N.J. 07481

[21] Appl. No.: 810,679

[22] Filed: Jun. 27, 1977

Related U.S. Application Data

[63] Continuation of Ser. No. 734,034, Oct. 20, 1976, abandoned.

[51] Int. Cl.[2] ..... B65B 10/46; B65B 57/14; B65B 9/08

[52] U.S. Cl. ..... 53/502; 53/551; 93/82; 177/60

[58] Field of Search ..... 53/59 W, 180 M, 182 M; 93/82; 177/60

[56] References Cited

U.S. PATENT DOCUMENTS

| | | | |
|---|---|---|---|
| 3,301,340 | 1/1967 | Lau | 177/60 |
| 3,583,126 | 6/1971 | McCollough | 53/180 M X |
| 3,681,892 | 8/1972 | Safranski | 53/180 M |
| 3,762,128 | 10/1973 | Persson et al. | 53/182 M |

*Primary Examiner*—Travis S. McGehee
*Attorney, Agent, or Firm*—Morris I. Pollack

[57] ABSTRACT

A web of flat polyethelene stock is drawn from a supply roll by a web feed mechanism, to be fed thereby up over a tube former then down, in tubular configuration, about a material fill pipe and then to and through pouch forming and weighing stations. A first spring biased nip roller, of the web feed mechanism, urges the flat polyethelene stock into engagement with one side of an appropriately powered drive roller, of the web feed mechanism, to effect the unreeling of the stock from the supply roll and to direct same up towards the tube former; while a second spring biased nip roller, of the web feed mechanism, urges the tubular stock into engagement with the other side of said drive roller to draw the stock down through said tube former and to and through said pouch forming and weighing stations. At the pouch forming station an "inverted — T" shaped heat sealing assembly effects a horizontal top seal and severs a pouch previously filled to a predetermined weight; while simultaneously sealing the lower horizontal extremity of the tube and a predetermined length of the vertical unsealed edges of the tube stock to form a new pouch ready for filling. The web feed mechanism, pouch forming assembly, tube former, fill pipe and attendant mounting structure are all housed in and on a main frame which is pivotally mounted on a fulcrum located in line with the center of gravity of said main frame. A weight responsive load cell supports the front of said main frame in such a manner as to be responsive to material being deposited in the pouch as it is filled. Appropriate controls are provided to arrest the material feed at selected weights, for control of the web feed and heat sealing (pouch forming) operations, and to insure proper balancing of the main frame with respect to said load cell.

33 Claims, 12 Drawing Figures

FIG. 8
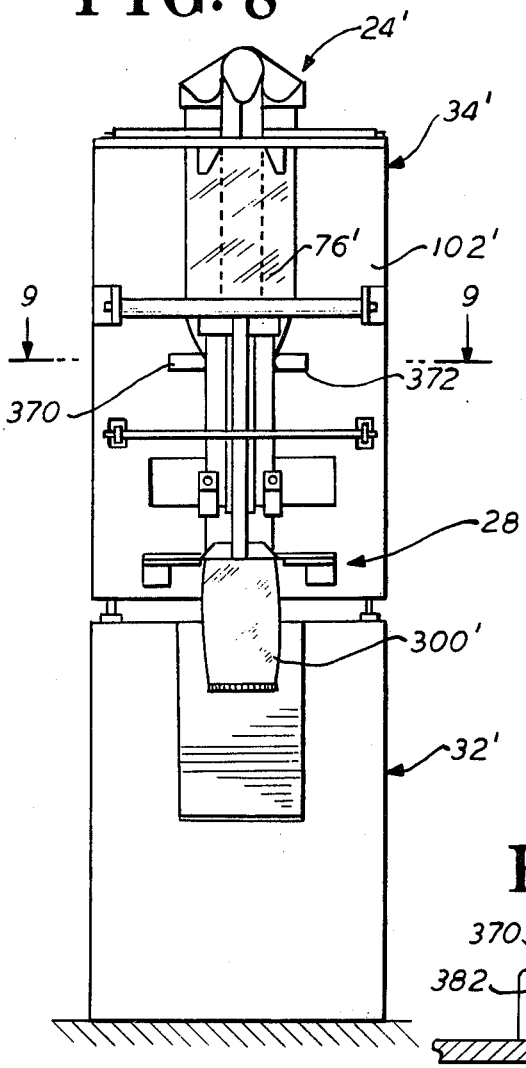
FIG. 7
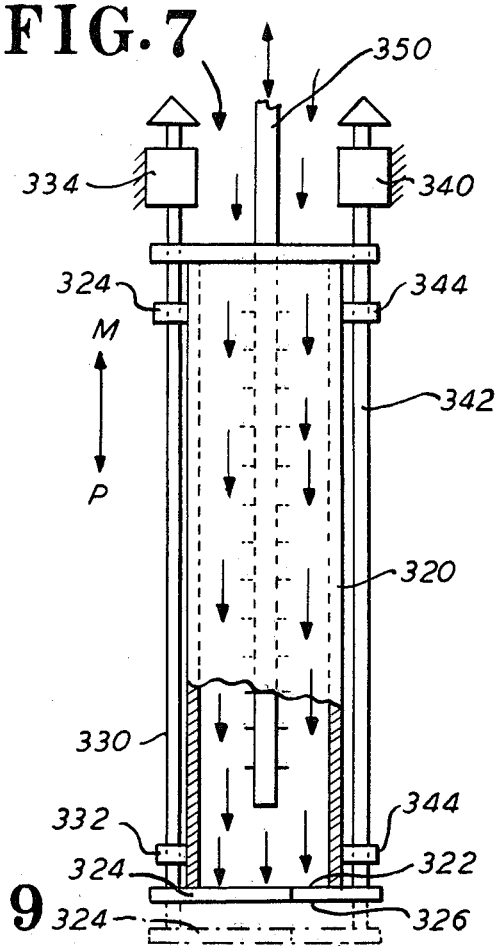
FIG. 9
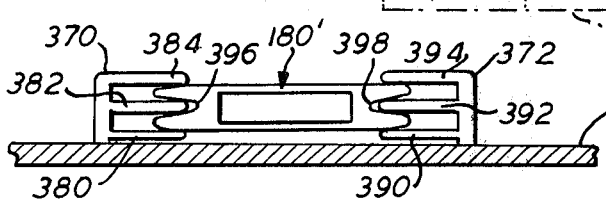
FIG. 11
| CIRCUIT ACTION | FUNCTION | TIMING |
|---|---|---|
| PB1,CR1,SOL.1 | CLOSE SEAL JAWS | |
| LS1,CR2,TR1,TX1 | SEALS FILM VERT. AND HORIZ. | TR1 |
| TR1,TR2,CR3,CR2 | COOLS FILM VERT. AND HORIZ. | TR2 |
| TR2,CR4,CR1 | RELEASE SEAL JAWS | |
| LS2 | FEED FILM | |
| TR2 FILL SWITCH | FEED PRODUCT | |
| RECYCLE BY FILLING UNIT THEN CR1,SOL.1 | CLOSE SEAL JAWS | |
| | | ETC. |

FLEXIBLE POUCH, FORMING, FILLING AND SEALING MACHINE

This is a continuation, of application Ser. No. 734,034, filed 10/20/76 now abandoned.

BACKGROUND OF THE INVENTION

1. Field of Application

This invention relates to packaging machines; and more particularly to machines which form packages from unsupported flexible material, fill such packages with bulk materials to selected weights, and seal such filled packages, all in a continuous and automatic manner.

2. Description of the Prior Art

More and more items are being marketed today in flexible containers, such as clear plastic bags or pouches; printed of course to indicate the contents, supplier and other usual information. This form of packaging is particularly suitable, and has in fact been widely used, for granular type materials like coffee, sugar, cocoa, dry milk, soaps, and many other powders. Rigid type containers (such as boxes, cans, jars, etc.) are generally more expensive to handle and store then flexible containers; and the equipment for moving rigid type containers to and through the filling process is usually more complex then that required for flexible containers. In addition flexible containers provide a more versatile container during use (because its size can be reduced as it is emptied); and one that is more easily disposed of when it is empty. After all, one must remember that a significant number of todays problems are ecological, that rigid containers (like boxes, cans, and jars) are bulky even when empty, and are usually not biodegradeable, while most flexible containers are of insignificant size when empty, and are made from material which is bio-degradeable.

Much equipment exists for the filling of such flexible containers; but equipment such as that shown in U.S. Pat. No. 1,979,492 granted to John Russell on Nov. 6, 1934 for Method of And Apparatus For Filling Bags With Powdered Or Granular Products, and that shown in U.S. Pat. No. 2,778,387 granted to William R. Diehl on Jan. 22, 1957 for Filling Machine, are only usable with individual containers and thus do not readily lend themselves to continuous automated type operations. Even at that the mechanisms shown are relatively complex in construction and operation. The weighing system of Russell requires the constant re-circulation and re-handling of the material to be packaged which not only adds to the cost of packaging same but also may affect the purity of the material being packaged.

In an attempt to automate the operation of flexible container filling some available equipment, such as that shown in U.S. Pat. No. 3,607,574 granted on Sept. 21, 1971 to Toshihiko Satake for Automatic Packaging Apparatus, utilize tubular stock in continuous roll form. But such equipment quite often still requires movement of the material to be packaged along a path separate and distinct from the tubular stock in order to facilitate the weighing thereof; and relatively complex and costly equipment for transporting the container to be filled to a position to receive the material (or of the material to the container). Subsequent sealing of the container in this type of equipment presents additional problems; while the user of this form of equipment must maintain an inventory of many sizes of tubular stock or greatly limit the packaging operation, by available sizes.

Other available flexible container packaging equipment, such as shown in U.S. Pat. No. 3,538,676 granted on Nov. 10, 1970 to William R. Runo et al for Packaging Machine, utilizes sheet stock and suitable tube forming equipment. Here again the material to be packaged must move along a separate and distinct path to be first weighed before entering into the container forming path. Runo et al dictates the use of highly complex web feeding equipment in order to feed the web stock to and through the tube former and the heat sealer. In addition, equipment such as that shown by Runo et al requires separate, distinct, and quite complex heat sealing units for effecting the vertical seal (to form the tube) and the horizontal seals (to form the bottom and top seals of the container).

Simpler web feeding equipment such as that shown in U.S. Pat. No. 2,913,192 granted on Nov. 17, 1959 to John T. Mullin for Tape Drive Mechanism, has been designed; but such mechanisms are more readily usable in the less demanding environment of tape equipment as shown in the patent. The mechanism is, in itself, quite peculiar in construction rendering it somewhat suitable for the narrow width of recording tapes but quite unsuitable for feeding webs to and through flexible container forming and filling equipment.

Other available equipment for forming flat stock into tubular material and then into flexible containers is shown in U.S. Pat. No. 3,729,359 granted to Claude E. Monsees on Apr. 24, 1973 for Continuous Tube Sealer. Here again the forming of the vertical seal is separate and distinct from the horizontal seal and is accomplished by relatively complex and expensive equipment. The controls, both mechanical and electrical, required in effecting separate and distinct vertical and horizontal seals are usually quite comlex and therefore more costly.

Less complex and costly heat sealing equipment are generally known, as shown in U.S. Pat. No. 2,730,161 granted on Jan. 10, 1956 to Nicholas Langer for Heat Sealing Machine Of The Termal Impulse Type and Method; and as shown in U.S. Pat. No. 3,490,981 granted on Jan. 20, 1970 to Frank G. Shanklin for Apparatus For Heat Sealing Plastic Film. These constructions, however, are not all suitable for use in substantially vertically disposed and continuously operated equipment for filling flexible containers with bulk material. In addition neither disclosure describes the requisite mechanical and electrical controls for use in such flexible container forming and filling equipment.

SUMMARY OF THE INVENTION

It is therefore an object of this invention to provide new and improved packaging equipment.

It is another object of this invention to provide new and improved equipment for filling flexible containers with bulk material.

It is still another object of this invention to provide new and improved equipment for forming flexible containers and for filling same with bulk materials.

It is yet another object of this invention to provide new and improved equipment for automatically and continuously forming flexible containers and or filling same with bulk materials.

It is yet still another object of this invention to provide new and improved equipment for automatically and continuously forming flexible containers from sheet stock and for filling same with bulk materials.

It is yet still a further object of this invention to provide new and improved feed mechanism for feeding unsupported flexible material to and through pouch forming apparatus of bulk material packaging equipment.

Yet still another object of this invention is to provide new and improved heat seal apparatus for flexible pouch forming and filling equipment.

Still a further object of this invention is to provide new and improved apparatus for simultaneously applying sealing heat to vertical and horizontal seams of a sheet stock being fed into pouch forming and filling equipment to form a pouch for filling while at the same time sealing and severing a previously filled pouch.

Yet still a further object of this invention is to provide new and improved apparatus for weighing bulk material as it is fed into a flexible container.

Still a further object of this invention is to provide new and improved apparatus for weighing bulk material as it is being fed into a flexible pouch formed at the end of a continuous tube in flexible pouch forming and filling equipment.

The invention involves a unitary drive roller assembly for feeding sheet stock of unsupported flexible material from a supply roll to and through a tube former and therefrom to and through pouch forming, filling, weighing, and separating operations to proide flexible containers filled with selected weights of bulk materials. The sealing of the longitudinal seam and the horizontal extremity of the tube to form a pouch for filling is accomplished by a unitary sealing apparatus which simultaneously seals the fill end of the previously filled pouch and may sever same from the continuous tube. The weighing, is accomplished while such material is being fed into pouch formed at the end of the continuous tube by mounting the apparatus for pivoting movement in response to the weight of the material being so fed and by terminating material feed ater sensing a predetermined degree of such pivoting movement indicative of the weight of material to be packaged.

Other object, features, and advantages of the invention in its details of construction and arrangement of parts will be seen from, the above, from the following description of the preferred embodiment when considered in conjunction with the drawings and from the appended claims.

BRIEF DESCRIPTION OF THE DRAWING

In the drawing:

FIG. 7 is a modified form of gating device for use with the machine of FIG. 1 for controlling the flow of material to be packaged;

FIG. 8 is a front elevational view of the machine of FIG. 1 modified to form pouches with gusseted sides;

FIG. 9 is a sectional view taken on line 8—8 of FIG. 7 with parts removed and enlarged to show details of the mechanism for forming gussets in the pouches;

FIG. 11 is a timing diagram for the machine of FIG. 1.

DESCRIPTION OF THE PREFERRED EMBODIMENT

For convenience, the invention will be described as applied to a machine for packaging granular material and which includes mechanism that feeds a web of flat, pre-printed, polyethelene stock to and through a tube former, to overlap the longitudinal edges of the stock; then feeds the stock so arranged about a material fill pipe that is rectangular in cross-section; and then feeds the stock to and through a heat sealing mechanism which seals a predetermined length of the overlapped longitudinal edges of the tube of stock, using the outer wall of the fill pipe as a back-up platen while simultaneously effecting a horizontal seal across the tube of stock. The horizontal seal so formed not only seals the top of the previously filled pouch, but also may, if desired, sever same from the tube while also forming the next pouch to be filled; but so that its upper edge remains open and integral with the end of the web of stock as it forms the stock tube about the material fill pipe. The tube former, material fill pipe, web feed mechanism and heat sealing mechanism are all carried by a support frame mounted to pivot about a fulcrum and co-acting with a weight responsive load cell; such that, as the material to be packaged drops into the open topped pouch, the entire support frame pivots about said fulcrum and at a pre-selected weight of material actuates the load cell to arrest passage of material into the fill pipe. It should be understood, nevertheless, that without departing from the scope of the invention that: the material to be packaged may be granular, a fluid, unwrapped or pre-wrapped bits (such a chocolate bits or candy drops), or for that matter any bulk material; that the web of stock may be any available stock material which can be formed into a tube and sealed in selected lengths; that it need not be pre-printed but may be otherwise labeled or even printed by suitable printing mechanism included with the packaging machine; that the material fill pipe may be circular in cross section or any other convenient configuration; that the sealing mechanism must correspond to the type of material from which the package is formed; that the sealing may take place against the outer wall of the fill pipe or against any member inserted therebetween; and that the pivoted frame may support more or less components of the packaging mechanism with the load cell calibrated accordingly.

Figure 1:
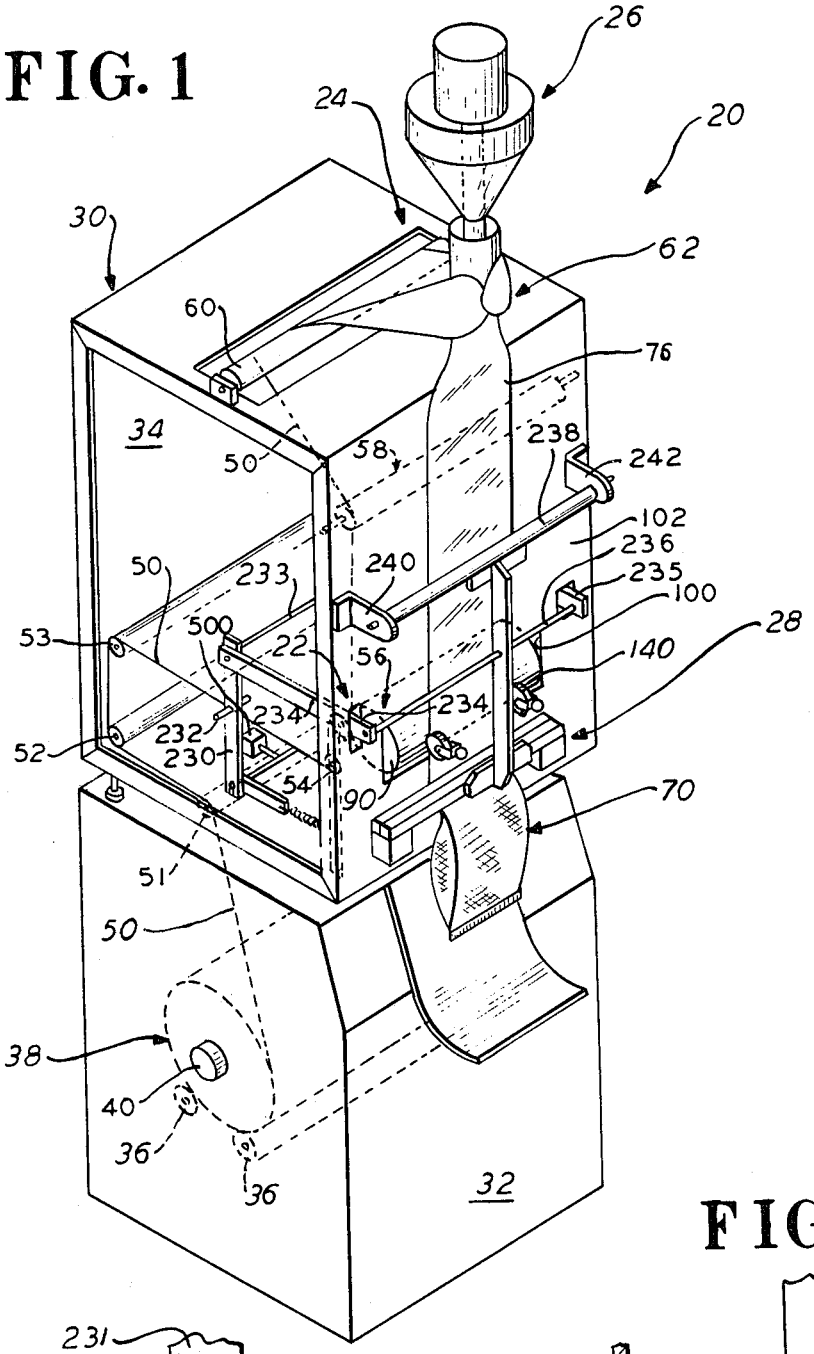
FIG. 1 is a schematic perspective showing of a flexible pouch forming, filling and sealing machine incorporating the instant invention.
Figure 3:
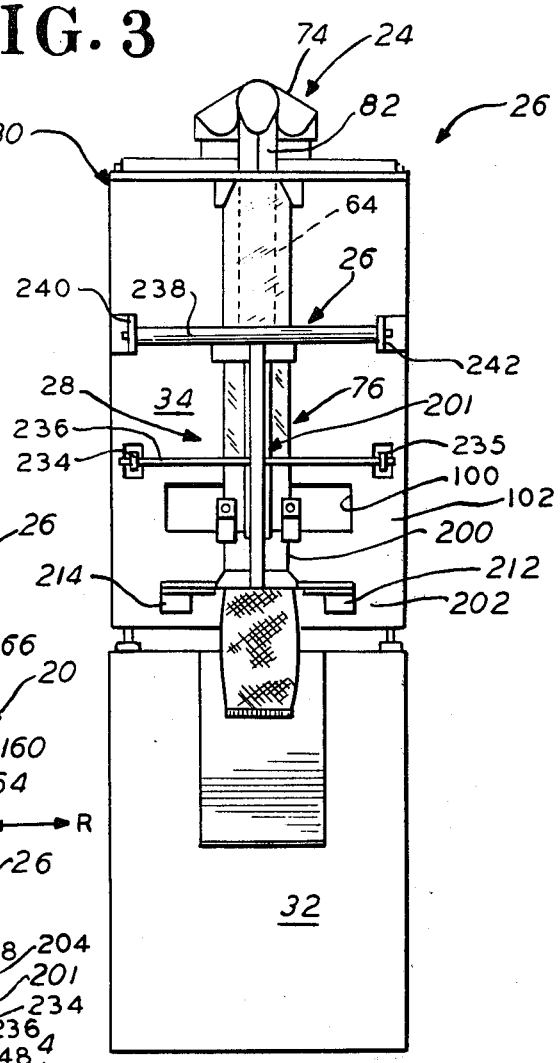
FIG. 3 is a front elevational view of the machine of FIG. 1.

With reference to FIG. 1 there is generally shown at 20 a packaging machine; or what may otherwise be refered to as a flexible pouch forming, filling and sealing machine. Packaging machine 20 (FIGS. 1, 2 and 3) include: a web feed mechanism 22 (FIGS. 1, 2, 4 and 5); a tube former 24 (FIGS. 1, 2, and 3); a material fill assembly 26; and a heat sealing assembly 28; all supported by, upon, and/or within a support cabinet 30.

Figure 2A:
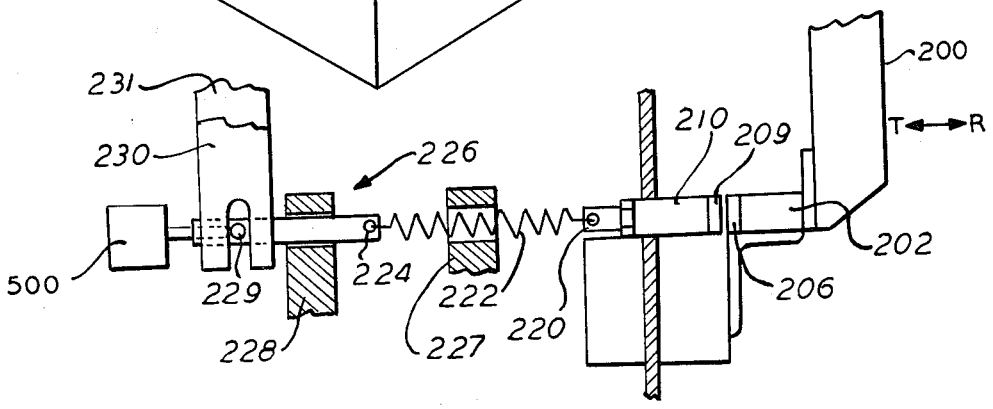
FIG. 2A is an enlarged detail view of a portion of the heat sealer operating mechanism.
Figure 2:
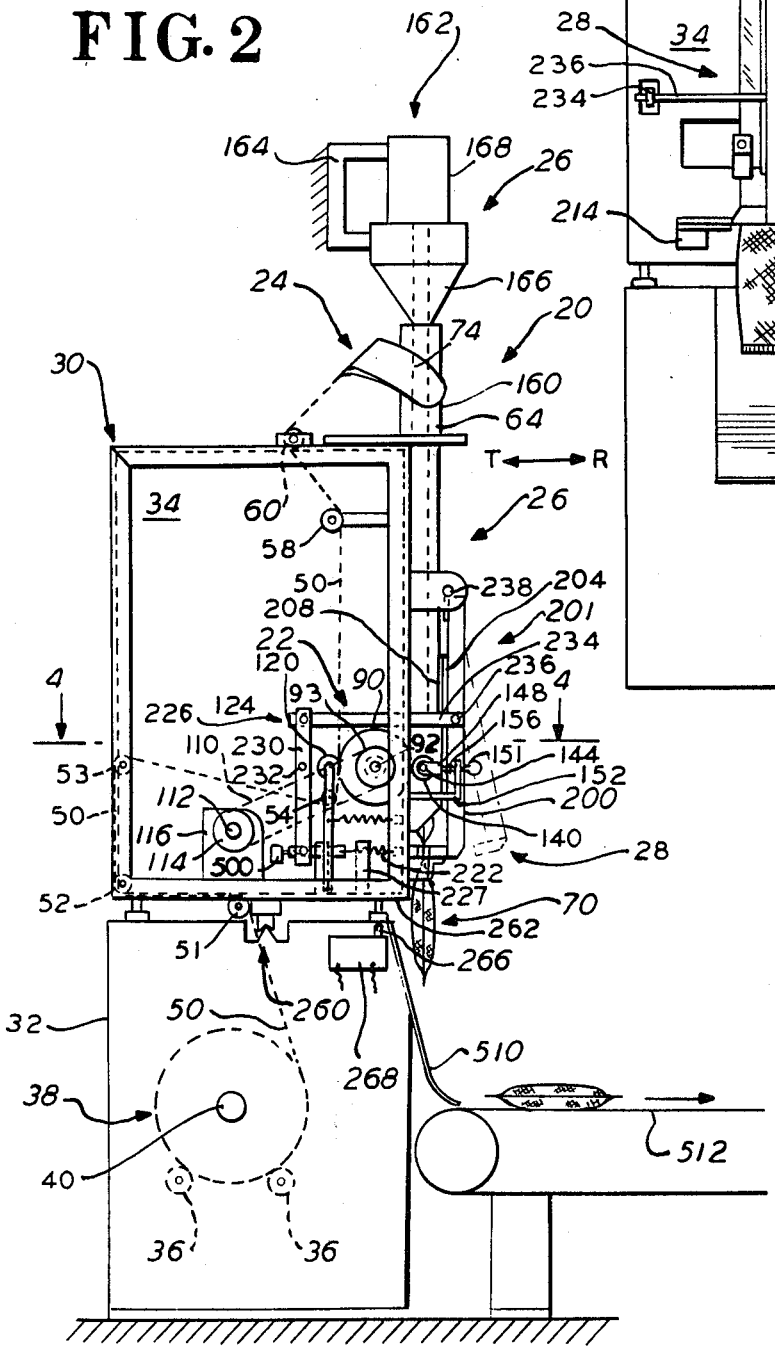
FIG. 2 is a side elevational view of the machine of FIG. 1 showing same in position proximate a conveyor for taking away filled pouches.

Cabinet 30 includes a base frame or support cabinet 32 and an upper or main frame or support cabinet 34. A pair of rollers 36, or other conventionally available and suitable mechanism to rotatably support a supply reel of flat, pre-printed polyethelene stock 38 (FIGS. 1 and 2). Stock 38 may be any suitable and commercially available heat sealable material. In general it is wound about a core 40 but may be provided in other commercially available forms. If preferred rollers 36 may be replaced by a suitably disposed mandrel, or the like, positioned to receive core 40 of supply reel 38 so that said reel 38 is freely and rotatably disposed within base frame 32.

Web 50 of stock 38 follows a web feed path, best shown in dashed lines in FIG. 2, which progresses about lower guide rollers 51, 52 and 53, an intermediate guide roller 54, through web drive assembly 56, about an upper guide roller 58, a top guide roller 60 to and about tube former 24, down and about a material fill pipe 64, passed heat sealing assembly 28, again through web drive assembly 56, to terminate in a pouch 70. Lower guide roller 51, 52 and 53 are rotatably mounted on suitable bearings or journals (not shown) in base frame 32; while intermediate guide roller 54, upper guide roller 58 and top guide roller 60, are likewise rotatably mounted on suitable bearings or journals (not shown) in main frame 34. Top guide roller 60 is adjustably mounted as shown in FIG. 2 to facilitate positioning thereof and tensioning of web 50. Tube former 24, is conventionally available and of a configuration such that web 50 moves over its back 74 in a flat condition; but is formed into a tube 76 (FIG. 4) with its longitudinal edges 78, 80 overlapping but unsealed as web 50 passes about and proximate face 82 (FIGS. 2 and 3) of tube former 24.

A main drive roller 90 (FIGS. 2, 4 and 5) of web drive assembly 56, is carried by a drive shaft 92 rotatably supported in journals or bearings 94, 96 suitably mounted in main frame 34 of cabinet 30 so that a face portion 98, (FIGS. 4 and 5) of roller 90, extends out from an opening 100 (FIG. 5) formed in a face panel 102 of main frame 30 below an exit 104 of material fill assembly 26. A drive transmitter, such as a belt or chain 110 (FIGS. 2 and 4) is appropriately entrained about drive shaft 92, as through a pulley or sprocket 93, to transmit thereto suitable motive power from a comparable drive member 114 of a motor 116 suitably mounted within main frame 34. Appropriate electrical connections (to be described in conjunction with the circuit diagram of FIG. 10) interconnect motor 116 to a suitable source of electrical power. A first pair of nip rollers 120, 122 (FIG. 4) are rotatively mounted upon stub shafts 124, 126 respectively carried by arms 128, 130 pivotally mounted as at 132 (FIG. 5) within main frame 34. A spring 136 (only one shown) is provided for arm 128 and arm 130; with one end of each such spring 136 connected to its respective arm 128, 130 and the other end of each such spring 136 fixedly secured within main frame 34 as of 139 so as to urge arm 128, 130 towards roller 90 and nip rollers 120, 122, carried by arms 128, 130 respectively into engagement with the drive surface of drive roller 90. A second pair of nip rollers 140, 142 (FIG. 4) are rotatively mounted upon pins 144, 146 respectively carried by forks 148, 150 mounted on adjustable stub shafts 151 carried by threaded brackets 152 secured to main frame 34. A spring 156 (only one shown) is disposed about each stub shaft 151 to urge forks 148, 150 toward drive roller 90 and nip rollers 140, 142, carried by forks 148, 150, respectively into engagement with the drive surface of drive roller 90. Rollers 120, 122, 140, and 142 may be mounted within main frame 34 as shown or otherwise disposed to coact with drive roller 90. In similar manner springs 136 and 156 may be otherwise disposed within main frame 34 as long as springs 136, 156 urge their respective arms 128, 130, forks 148, 150 and nip rollers 120, 122 and 140, 142 into engagement with the surface of drive roller 90.

Figure 5:
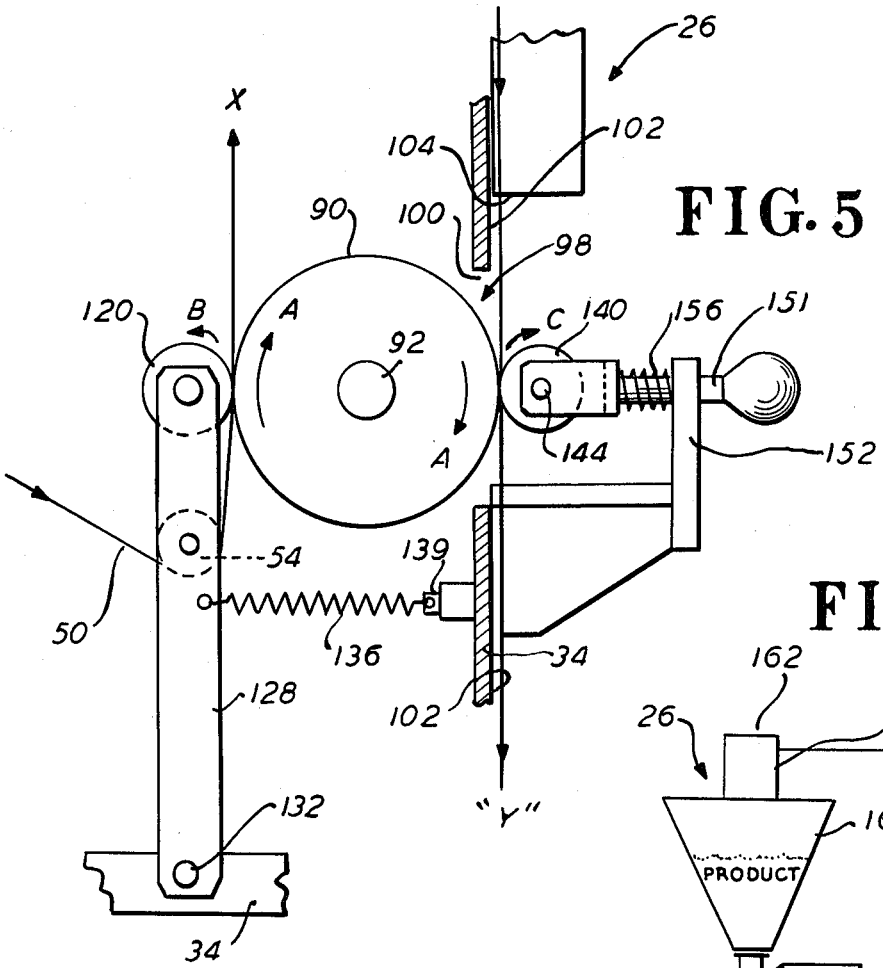
FIG. 5 is a schematic showing of the film feed mechanism of FIG. 4.

When motor 116 is energized, as will be hereinafter described, power therefrom is transmitted by drive member 114 to drive transmitter 110, drive roller shaft 92 and drive roller 90 to rotate drive roller 90 in the direction of Arrows "A" (FIG. 5). Nip rollers 120, 122, urged by springs 136 into engagement with the moving surface of drive roller 90 are driven thereby in the direction of Arrows "B" to draw web 50 between rollers 120, 122 and drive roller 90 and send same up in the direction of arrow "X". In similar manner nip rollers 140, 142, urged by springs 156 into engagement with the moving surface of drive rollers 90 are driven thereby in the direction of arrow "C" to draw web 50 between rollers 140, 142 and drive roller 90 and send same down in the direction of arrow "Y". The interaction of drive roller 90, and nip rollers 120, 122, 140, 142 upon web 50 maintains same with the proper degree of tension over guide rollers 51, 52, 53, 54, 58 and 60 and for coaction with tube former 24 and avoids the necessity of a slack loop and dancer roll that is commonly found in web feeds. Since both pairs of nip rollers (120, 122 and 140, 142) respectively co-act with opposite surfaces of a single drive roller 90 the amount of web 50 fed in the direction of arrow "X" always equals the amount of web 50 fed in the direction of arrow "Y" thus providing a simple but quite efficient web feed.

Figure 4:
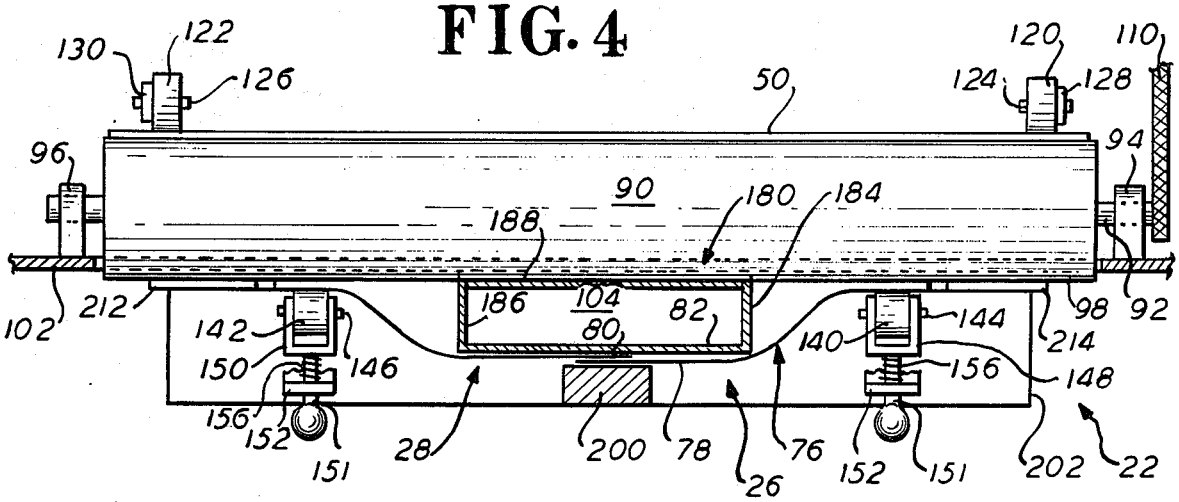
FIG. 4 is a sectional view taken on line 4—4 of FIG. 2 with parts removed and on an enlarged scale to better show details of the film feed mechanism.

As previously described when web 50 passes through tube former 24 it is formed into a web 76 with overlapping but unsealed edges 78, 80 (FIG. 4). Tube 76 is formed about a material fill pipe 64 of material fill assembly 26. Material fill pipe 64 is carried by main frame 34 and includes an upper or material receiving section 160 (FIG. 2) disposed to receive the material to be packaged from a material storage enclosure 162 of conventional configuration and which is secured in position, as at 164 so as not to transmit its weight, or the weight of the stored material, to main frame 34. The reasons for this will be explained later in conjunction with the apparatus for weighing the filled pouches. Enclosure 162 may include a funnel shaped material discharge device 166 disposed to receive the stored material from a storage bin 168; as well as suitable and conventionally available mechanism 170 (not shown) for assisting the discharge of the stored material from bin 168 and discharge device 166. Such mechanism may merely be a gate which would either block or open the material discharge opening; semi or an auger type feed device if the material is grannular and of the type that might clog the discharge opening rather then freely pass through same. Suitable electrical connections are made from said discharge assisting mechanism to an appropriate source of electrical power to operate same as will be hereinafter explained in conjunction with the circuit diagram of FIG. 10.

Tube 76 extends down about material fill 64 to surround a lower or material discharge section 180 thereof which is formed with a rectangular cross section including front wall 182 (FIG. 4) side walls 184, 186 and a rear wall 188 and terminates in discharge opening 104. Material receiving section 160 of fill pipe 64 may also be of rectangular cross section or of any other suitable and convenient cross section. Rear wall 188 is spaced from face wall 102 of main frame 34 to permit tube 76 to pass therebetween.

Front wall 82 of material discharge section 180 of fill pipe 64 is positioned for coaction with a vertically extending leg 200 (FIGS. 2 and 4) of heat sealer 201 of heat sealing assembly 28. Heat sealer 201 is substantially in the configuration of an inverted "T" with its leg 200 aligned with overlapping edges, 78, 80 of tube 76 and with its cross-arm 202 of a width sufficient to span tube 76, and of a height sufficient to form a top seal for a previously filled pouch 70 and a bottom seal for the tube 76 still forming part of web 50. The facing surface 204 of leg 200, and the facing surface 206 (FIG. 2A) of cross-arm 202 are formed in conventional manner to be heated for the purpose of sealing the film edges together and with a finish that facilitates release of leg 200, cross-arm 202 and their respective surfaces 204, 206 from the film so sealed. Comparable surface 208 and 209 are disposed for coaction with surfaces 204 and 206 to facilitate the sealing operation. Suitable controls and electrical power are provided for heat sealing assembly 28 to control same and to energize the heating elements thereof as well as for an actuating solenoid 210 (FIG. 2A) and a pair of electromagnets 212, 214, all disposed for coaction with heat sealer 201. Electromagnets 212, 214 are suitably secured to main frame 34 in position to coact with the ends of cross-arm 202 of heat sealer 201. Solenoid 210 is also disposed on main frame 24 and includes a plunger 220 (FIG. 2A) connected at one of its ends to surface 209 and at its other end to a spring 222, which at its other end is connected to a pin 224 of heat sealer operating machanism 226. A pair of guide blocks 227, 228 are carried by frame 34 to guide the movement of spring 222 and pin 224.

Operating mechanism 226 includes a cross-beam 229, connected to pin 224, and carried by a pair of spaced levers 230, 231 which are in turn rockably disposed at 232 within main frame 34. Pivotally connected as at 233 to the top of each lever 230, 231 is an operating rod 234, 235 the front end of each rod 234, 235 (FIG. 3) extending through face panel 102 of main frame 34. Interconnected between the front ends of rods 234 and 235 is an operating rod 236 which also passes through an aperture appropriatedly formed in leg 200 of heat sealer 201.

The upper end of leg 200 of heat sealer 201 is rockably carried by a pivot shaft 238 disposed between a pair of ears 240, 242 fixedly positioned on face panel 102 of main frame 34.

When solenoid 210 is energized, as will be hereinafter explained, plunger 222 thereof will move against the action of spring 222 in the direction of arrow R. This action not only moves surface 209 in the direction of arrow R for future coaction with surface 206 of cross-arm 202 of heat sealer 201, but also, through the action of spring 222 draws pin 224 and cross-beam 229 in the direction of arrow R. Such movement of cross-beam 229 results in a counterclockwise rocking of levers 230 and 231 about cross-shaft 232 (FIG. 2) and a linear movement of operating rods 234, 235 in the direction of arrow T (FIG. 2). As rods 234 and 235 so move, they will act upon operating rod 236 to rock heat sealer 201 in the clockwise direction (FIG. 2) about pivot shaft 238 to move surfaces 204 and 206 thereof towards surfaces 208 and 209 and press therebetween those portions of the film of tube 76 which are to be heat sealed.

Electromagnets 212, 214 are energized, through electrical controls to be hereinafter described as cross-arm 202 approaches same to pull surfaces 204 and 206 of heat sealer 201 firmly against surfaces 208 and 209.

Upper or main frame 34, of cabinet 30, is pivotally balanced upon lower or base frame 32; with the fulcrum or pivot 260 (FIGS. 1 and 2), about which main frame 34 pivots, aligned with the center of gravity of main frame 34 taking into consideration all the components and mechanisms secured to or carried by main frame 34. A frnt part 262 of main frame 34 is balanced upon an actuating element 266 of a weight responsive load cell 268 appropriately positioned in base frame 32. Weight responsive load cell 268 (FIGS. 2 and 6) is of conventionally available construction electrically interconnected through suitable interconnection means, such as schematically shown at 270 in FIG. 6, to a source of electrical power and appropriate controls to enable the zeroizing of the system as well as the adjustment therefore to be responsive to any one of many selected weights. Also interconnected into interconnection means 270 is the feed device (whether it be an auger or gate) for beginning the feed of material, to be packaged, from enclosure 162 through fill pipe 64 into tube 76 and for arresting the flow of such material when the desired weight is attained. As the material drops down fill pipe 64 into the open topped pouch 300 formed at the end of tube 76 (which has previously been sealed across its bottom and for a predetermined length up its overlapping ends 78, 80 by heat sealer 201) the weight thereof increases to unbalance main frame 34 and cause same to pivot in the counterclockwise direction (FIG. 6) about fulcrum 260. When the selected weight is attained actuator 266 operates load cell 268 to arrest operation of the material feed mechanism. It should be understood that load cell 268 will have been appropriately calibrated to account for material which is in fill pipe 64 prior to terminating material feed, and which will drop into pouch 300.

One form of gating device for use with material enclosure 162 is shown in FIG. 7 wherein the storage bin 168 thereof includes a storage tube 320 terminating in an exit opening 322 which can be closed off by a bulk feed gate 324 and a dribble feed gate 326. Bulk feed gate 324 is affixed to the end of an operating rod 330 guided for movement in the directions of arrows M and P by guide loops 332 affixed to the side of tube 320. A bulk feed solenoid 334 is suitably connected to operating rod 330 and into the electrical circuit (as will be hereinafter described) to move bulk feed gate 324 between its gate open position (dashed lines FIG. 7) wherein it permits material to flow into material fill tube 64 and pouch 300, and its gate closed position (solid lines FIG. 7) wherein it blocks the flow of material from enclosure 162.

A dribble feed solenoid 340 is suitably connected into the electrical circuit and to an operating rod 342, and guided for movement in the directions of arrows M and P by a pair of guide loops 344 affixed to the side of tube 320. Dribble gate 326 is affixed to the end of rod 342 and is operated in a manner similar to bulk feed gate 324.

Figure 6:
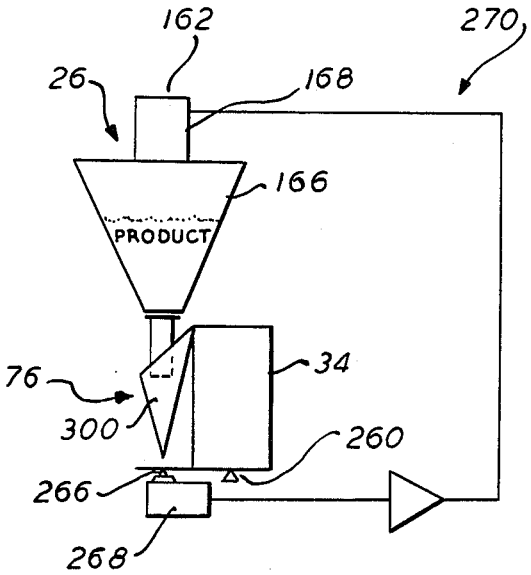
FIG. 6 is a schematic line diagram illustrating the principal of operation of the weight responsive fill system for the machine of FIG. 1.
Figure 10:
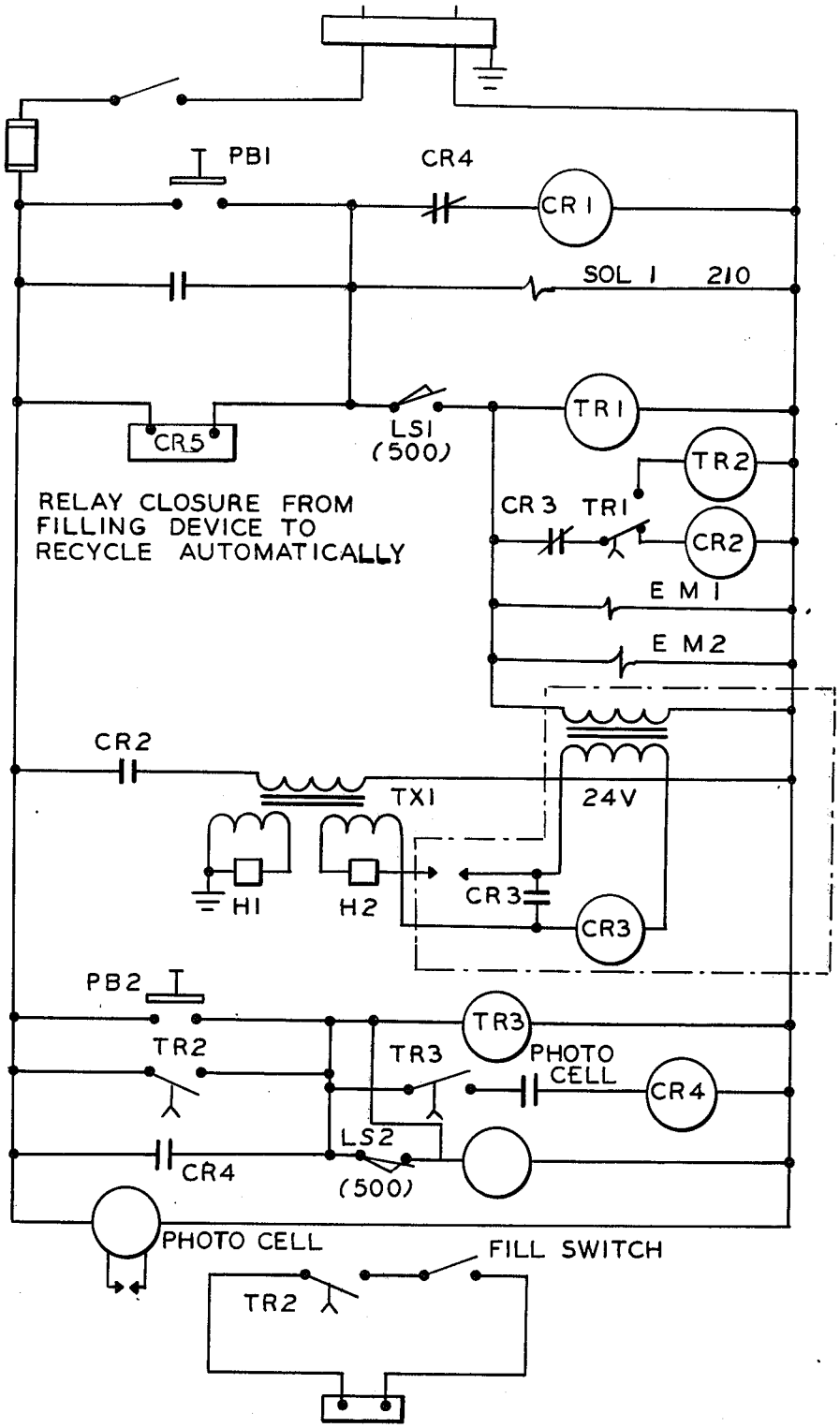
FIG. 10 is a schematic circuit diagram of the controls for the machine of FIG. 1.

When the material fill operation is initiated, as will be hereinafter explained with the circuit diagram of FIG. 10, both bulk feed solenoid 334 and dribble feed solenoid 340 will be operated to move their respective operating rods 330 and 342 in the direction of arrow P. Bulk gate 324 and dribble gate 326 will thus be moved away from exit opening 322 and the material will drop down fill pipe 64 into pouch 300 (FIG. 6). As the weight of pouch 300 (and the unbalance of main frame 34) approaches a first level, pre-set into the control circuit through appropriate and conventionally available adjustment means, bulk feed solenoid will be signaled to pull operating rod 330 in the direction of arrow M (FIG. 7) to close off a main portion of exit opening 322. Material will continue to dribbel out from opening 322 until the desired weight for pouch 300 is attained. At an appropriate time a signal will be sent to dribble feed solenoid 340 to draw its rod 342 in the direction of arrow M (FIG. 7) to close off the rest of opening 322 and completely stop material feed to pouch 300.

When the material to be packaged is sticky, or otherwise tends to clog, a conventionally available vibrating device 350 (FIG. 7) may be secured to suitable elements of the material fill or storage mechanism to vibrate the clog loose. Actuation of vibrating device 350 may be either continuous or operator initiated In FIGS. 8 and 9 there is shown a main frame 34' with a face panel 102' to which there has been affixed a pair of gusset formers 370, 372. Gusset former 370 includes a number of fingers 380, 382, 384 (FIG. 9); while gusset former 372 includes similar fingers 390, 392, 394. Fingers 382 and 392 extend into the path of movement of tube 76' after it passes through tube former 24' to indent the sides of tube 76' at 396 and 398 respectively. Fingers 380, 384, 390, and 394 act as guides for the material of tube 76' on each side of such indents 396, 398. As such pouch 300' is formed with gussets in its sides should such be desired for the final package.

The operation of packaging machine 20 will be described in conjunction with the circuit diagram of FIG. 10 and the timing diagram of FIG. 11. It should be understood that the various electrical components are of conventionally available construction and that they are interconnected into the operation and control circuit (schematically shown in FIG. 10) for packaging machine 20 in essentially conventional manner by suitable electrically conductive wires, cables, busses and the like, and that appropriate power is available and connectable therewith.

Prior to starting up packaging machine 20 the operator should see to it that is is connected up to the electrical power supply and that a roll of appropriately sized and printed stock 38 is in position on rollers 36 in base frame 32. Web 50 of stock 38 should then be fed along the web feed path about guide rollers 51, 52, 53 and 54, between nip rollers 120, 122 and drive roller 90, about guide rollers 58 and 60, through web former 24, and then down about material fill pipe 64 in the configuration of a tube 76 with its edges 78, 80 overlapping but unsealed. A supply of material to be packaged is disposed in material enclosure 162 and the gating device therefore (whether it be an auger, a single gate, or multiple gate such as that of FIG. 7) is set so that no material can be dispensed therefrom. Accordingly material fill pipe 64 is empty and load cell 268 can be calibrated to zero by the controls provided therewith. Thereafter the operator should set the weight selector for load cell 268 to the desired weight of material to be packaged.

Once packaging machine 20 has been set up to the operator initiates packaging operations by depressing push button PB1. This closes the circuit to control relay CR1 and the closing of its contacts completes the circuit to and energizes solenoid SOL1 (210-FIG. 3). Energization of solenoid 210 through plunger 220 and heat sealer operating mechanism 226 rocks heat sealer 201 in the clockwise direction about pivot shaft 238 (FIG. 2) to move leg 200 and cross-arm 202 of heat sealer 201 towards heat sealing surfaces 208 and 209 to press therebetween the unsealed edges of web 50 as it forms the lower portion of tube 76. This movement also operates on the movable contact of a limit switch 500 disposed on main frame 34 for coaction with cross-bearer 229 (FIGS. 1 and 2A) of heat sealer operating mechanism 226.

The operation of the contacts LS1 of limit switch 500, in turn, closes the circuit to a timed delay relay TR1 to start a predetermined timed operation thereof. The appropriate contacts of timed delay relay TR1, in turn, close the circuit to a control relay CR2; while other contacts of timed delay relay TR1 close the circuit to electromagnets EM1 (212-FIG. 4) and EM2 (214-FIG. 4). The action of electromagnets EM1 (212) and EM2 (214) as previously explained is to act upon cross-arm 202 of heat sealer 201 and draw some tight against surfaces 208 and 209 to tightly press tube 76 therebetween.

Energization of conrol relay CR2 completes a circuit to a power transformer TX1 and through appropriate circuitry to a pair of heating elements H-1 and H-2 for leg 200 and cross-arm 202 respectively, of heat sealer 201. The application of heat from heaters H-1 and H-2 to heat sealer 201 continues until timed delay relay TR-1 times out; at which time the circuit to control relay CR-2 is opened and power to transformer TX-1 removed from heaters H-1 and H-2. The operation of timed delay relay TR-1 timing out also initiates timed operation of a timed delay relay TR-2 to maintain the circuit to electromagnets EM-1 (212) and EM-2 (214) to maintain heat sealer 201 closed against tube 76but while heat is not being applied thereto. This provides for a cooling period during which the seals for pouch 70 can set up.

When timed delay relay TR-2 times out it closes the circuits to energizea control relay TR-3; to energize a control relay CR-4. A first set of controls of energized control relay CR-4, are operated to open the circuit to control relay CR-1. This de-energized electromagnets EM-1 (212) and EM-2 (214), and permits spring 222 through operating mechanism 226 to rock heat sealer 201 in the counterclockwise direction (FIG. 2) about pivot shaft 238 and away from tube 76. A pouch 70 sealed across its bottom and for a predetermined length up seams 78 and 80 has now been formed at the bottom of tube 76. The open top of pouch 70 is disposed about exit 104 of material fill tube 64 ready to receive material therefrom The resulting moement of heat-sealer 201, and corresponding movement of cross-bearer 229 acts upon the operating element of limit switch 500, secured within main frame 34, to operate the contacts SL2 of limit switch 500 which in turn completes the circuit to motor 116 (M-1) to rotate drive roller 90 and feed another pre-selected length of web 50 through tube former 24 to form an additional length of tube 76. The feed of web 50 continues until timed delay relay TR-3 times out, which action de-energizes control relay CR-4. De-energization of control relay CR4, in turn, opens a pair of its contacts in circuit with web feed motor M1 (116) to arest feed of web 50 at a pre-selected length comparable to the size of the length of tube 76 for a pouch. In the alternative web 50 during the printing thereof, or in a separate marking operation, may have marks applied thereto at pre-selected distances corresponding to the length of web 50 to be fed with each operation of motor M1. An appropriate photocell device may be disposed in main frame 34 and included in the circuit so as to be responsive to such marks and to arest operation of motor M1 upon sensing each successive mark.

The timing out of timed delay relay TR2 also initiates feed of material from material enclosure 162 by initiating operation of material discharge assisting mechanism 170. As previously described discharge assisting mechanism 170 may be a conventionally available auger type feed or it may be a gated device such as shown in FIG. 7. When the appropriate weight of material is in pouch 70 main frame 34 will act upon load cell 268, as previously described, to arrest material feed. This action also operates a control relay CR5 which re-initiates the cycle by energizing control relay CR1, and solenoid SOL1.

With each subsequent operation of heat 201 cross-arm 202 thereof not only provides a seal for the bottom of the next pouch 70 but it also provides a top seal for the previously filled pouch 70. The sealing action of heat sealer 201 may also affect a line of separation between the bottom seal for such next pouch 70 and the top seal of the previous pouch 70. This is acomplished by conventionally available means such as a heated wire disposed across cross-arm 202 and bisecting same. After a filled pouch 70 is so severed, and when it is released (by the opening of heat sealer 201) the filled pouch 70 will slide down a cirved guide plate 510 (FIG. 2) and from there either into a box or container, or onto a conveyor 512 to move same away from packaging machine 20. Conveyor 512 may be of any conventional configuration, suitably operated and may either be permanently disposed with respect to packaging machine 20 or portable.

From the above description it will thus be seen that there has been provided novel and improved web feed, heat sealing, and weighing mechanisms for a packaging machine which mechanisms are relatively simple in design, construction and operation and contribute towards an efficient, and cost reduced and comparatively less expensive packaging configuration.

It is understood that although I have shown the preferred form of my invention that various modifications may be made in the details thereof without departing from the spirit as comprehended from the following claims:

I claim:

1. A packaging machine: comprising (a) component support means;

(b) packaging stock support means carried by said component support means for positioning a supply of flat packaging stock proximate the beginning of a stock feed path;

(c) stock feed means for feeding packaging stock to and through said stock feed path;

(d) a tube former carried by said component support means proximate said stock feed path for receiving packaging stock as it moes therealong and for forming the flat stock into a tubular configuration with the longitudinally extending edges of the stock overlapping but not secured together;

(e) packaging material sealing means carried by said component support means proximate said stock feed path and for coaction with the packaging material after it has been formed into a tubular configuration by said tube former to effect a seal across the width of the tube so formed and for a predetermined extent of the overlapping edges of the packaging stock in the longitudinal direction thereof from the seal across the width of the tube to thereby form a pouch at the end of the tube of packaging material for the receipt of material to ba packaged;

(f) material directing means carried by said component support means proximate said stock feed path for directing material to be packaged into the pouch formed at the end of the tube of packaging material;

(g) material responsive means carried by said component support means and responsive to the amount of material entering the pouch at the end of the tube of packaging material;

(h) selectively settable means coacting with said material responsive means and selectively settable to a plurality of desired amounts of material; and (i) control and circuit means interconnecting said stock feed means, said package material sealing means, and said material responsive means into an integrated and coordinated system, said material responsive means providing an output signal to arrest the flow of material to said material directing means upon sensing that the selective set amount of material has been deposited in the pouch.

2. The packaging machine of claim 1: wherein (a) said stock feed path for at least a predetermined length thereof preceeds in a first direction, and then in a second direction substantially opposite but somewhat parallel to said first direction; and (b) said stock feed means includes stock drive means disposed for coaction with the packaging stock proximate said predetermined length of said stock feed path, to feed the stock in both said first direction and said second direction.

3. the packaging machine of claim 2 wherein said stock drive means includes drive roller means rotated about a predetermined axis of rotation and having formed thereon a drive surface which at a first location along said predetermined length of said stock feed path is disposed for coaction with the packaging stock to move same in said first direction, and which at a second location along said predetermined length of said stock feed path is disposed for coaction with the packaging stock to move same in said second direction; said first location and said second location being disposed to opposite sides of said predetermined axis of rotation on substantially a diametrical line through said axis of rotation.

4. The packaging machine of claim 3 wherein said stock drive means includes first pressure roller means disposed proximate said first location and so as to urge the packaging stock against said drive surface at said first location; and second pressure roller means disposed proximate said second location and so as to urge the packaging stock against said drive surface at said second location.

5. The packaging machine of claim 1: wherein (a) the packaging stock support means is for positioning a supply of flat heat sealable film which will constitute the packaging stock; and (b) said packaging material sealing means includes an inverted substantially "T" shaped heat sealer which is disposed for coaction with the tube of packaging stock to effect the seal across the width thereof and for the predetermined length along the longitudinal edges thereof.

6. The packaging machine of claim 5 wherein said material directing means includes a material fill tube at least a portion of which is disposed proximate said heat sealer for coaction therewith and to have pressed thereagainst the packaging stock while the seals are being effected.

7. The packaging machine of claim 6 wherein said portion of said material fill tube is rectangular in cross-sectional configuration and provides a relatively flat surface for coaction with said heat sealer and wherein said heat sealer is formed as an integral "T" shaped unit with the vertical leg thereof coacting with said flat surface of said portion of said material fill tube.

8. The packaging machine of claim 1 wherein said material responsive means includes a load cell responsive to the weight of material to be packaged when deposited in the pouch at the end of the tube of packaging material but only after it has been so deposited.

9. The packaging machine of claim 8 wherein said component support means includes a base portion and a main frame portion pivotally supported on said base portion by fulcrum means; said main frame portion supporting at least said packaging material sealing means and said material directing means and in turn being balanced upon said load cell in such a way that said load cell is responsive to material to be packaged as the end of the tube of packaging material.

10. The packaging machine of claim 9 wherein said main frame portion also supports said stock feed means and said tube former.

11. A packaging machine; comprising:

(a) component support means;

(b) packaging stock support means carried by said component support means for positioning a supply of packaging stock in flat condition proximate the beginning of a stock feed path;

(c) stock feed means for feeding packaging stock to and through said stock feed path;

(d) said stock feed path for at least a predetermined length thereof proceeding in a first direction, and then in a second direction substantially opposite but somewhat parallel to said first direction; and (e) said stock feed means including stock drive means disposed for coaction with the packaging stock, proximate said predetermined length of said stock feed path, to feed the stock in both said first direction and said second direction;

(f) forming means carried by said component support means proximate said stock feed path for receiving packaging stock as it moves therealong and for forming the flat stock into an open tubular configuration;

(g) packaging material sealing means carried by said component support means proximate said stock feed path and for coaction with the packaging material after it has been formed into said open tubular configuration by said forming means to effect a seal across at least the width of the open tube so formed to thereby form a pouch at the end of the tube of packaging material for the receipt of material to be packaged.

(h) material directing means carried by said component support means proximate said stock feed path for directing material to be packaged into the pouch formed at the end of the tube of packaging material;

(i) material responsive means carried by said component support means and responsive to the amount of material being so directed;

(j) selectively settable means coacting with said material responsive means and selectively settable to a plurality of desired amounts of material; and (k) control and circuit means interconnecting said stock feed means, said package material sealing means, and said material responsive means into an integrated and coordinated system, said material responsive means providing an output signal to arrest the flow of material to said material directing means upon sensing the selective set amount of material.

12. The packaging machine of claim 11, wherein said stock drive means includes drive roller means rotated about a predetermined axis of rotation and having formed thereon a drive surface which at a first location along said predetermined length of said stock feed path is disposed for coaction with the packaging stock to move same in said first direction, and which at a second location along said predetermined length of said stock feed path is disposed for coaction with the packaging stock to move same in said second direction; said first location and said second location being disposed to opposite sides of said predetermined axis of rotation on substantially a diametrical line through said axis of rotation.

13. The packaging machine of claim 12, wherein said stock drive means includes first pressure roller means disposed proximate said first location and so as to urge the packaging stock against said drive surface at said first location; and second pressure roller means disposed proximate said second location and so as to urge the packaging stock against said drive surface at said second location.

14. The packaging machine of claim 12, wherein the packaging stock is flat non-tubular material whose longitudinally extending edges are placed in overlapping condition when the stock coacts with said forming means; said package sealing means also effecting a seal for a predetermined length of the overlapping edges.

15. Pouch forming equipment; comprising:

(a) component support means;

(b) packaging stock support means carried by said component support means for positioning a supply of flat packaging stock proximate the beginning of a stock feed path;

(c) stock feed means for feeding packaging stock to and through said stock feed path;

(d) a tube former carried by said component support means proximate said stock feed path for receiving packaging stock as it moves therealong and for forming the flat stock into a tubular configuration with the longitudinally extending edges of the stock overlapping but not secured together;

(e) packaging material sealing means pivotally carried by said component support means proximate said stock feed path and for coaction with the packaging material after it has been formed into a tubular configuration by said tube former to effect a seal across the width of the tube so formed and for a predetermined extent of the overlapping edges of the packaging stock in the longitudinal direction thereof from the seal across the width of the tube to thereby form a pouch.

16. The pouch forming equipment of claim 15, wherein:

(a) said packaging stock support means is for positioning a supply of flat heat sealable film which will constitute the packaging stock; and (b) said packaging material sealing means includes an inverted substantially "T" shaped sealer which is pivotally carried by said component support means for coaction with the tube of packaging stock to effect the seal across the width thereof and for the predetermined length along the longitudinal edges thereof.

17. The packaging machine of claim 15 wherein said seal extending for a predetermined extent of the overlapping edges of the packaging stock in the longitudinal direction is disposed proximate the center of one side of the pouch so formed.

18. A packaging machine; comprising:

(a) support means;

(b) pouch positioning means carried by said support means for positioning a pouch in a predetermined position to be filled with material to be packaged;

(c) material directing means carried by said support means for directing material to be packaged into a pouch when carried by said pouch positioning means;

(d) fulcrum means mounting said support means, and said pouch positioning means and material directing means carried thereby, for movement about a predetermined axis of rotation and in a predetermined direction upon entry of material into a pouch;

(e) material responsive means including a load cell disposed for coaction with said support means when moving in said predetermined direction about said predetermined axis of rotation as material enters the pouch;

(f) selectively settable means coacting with said material responsive means and selectively settable to a plurality of desired amount of material;

(g) control and circuit means interconnecting said selectively settable means and said material rsponsive means into an integrated and co-ordinated system, said material responsive means providing an output signal to arrest the flow of material to said material directing means upon sensing that the selective set amount of material has been deposited in the pouch.

19. A packaging machine; comprising:

(a) component support means;

(b) packaging stock support means carried by said component support means for positioning a supply of packaging stock proximate the beginning of a stock feed path;

(c) stock feed means for feeding packaging stock to and through said stock feed path;

(d) a tube former carried by said component support means proximate said stock feed path for receiving packaging stock as it moves therealong and for forming the stock into an open tubular configuration;

(e) packaging material sealing means carried by said component support means proximate said stock feed path and for coaction with the packaging material after it has been formed into a tubular configuration by said tube former to effect a seal across the width of the tube so formed to thereby form a pouch at the end of the tube of packaging material for the receipt of material to be packaged;

(f) material directing means carried by said component support means proximate said stock feed path for directing material to be packaged into the pouch formed at the end of the tube of packaging material;

(g) material responsive means carried by said component support means and responsive to the amount of material entering the pouch at the end of the tube of packaging material;

(h) selectively settable means coacting with said material responsive means and selectively settable to a plurality of desired amount of material; and (i) control and circuit means interconnecting said stock feed means, said package material sealing means, and said material responsive means into an integrated and co-ordinated system, said material responsive means praoviding an output signal to arrest the flow of material to said material directing means upon sensing that the selective set amount of material has been deposited in the pouch.

20. The packaging machine of claim 19; wherein said component support means includdes a base portion and a main frame portion pivotally supported on said base portion by fulcrum means; said main frame portion supporting at least said packaging material sealing means and said material directing means and in turn being balanced upon a load cell in such a way that said load cell is responsive to material to be packaged at the end of the tube of packaging material.

21. The packaging machine of claim 20, wherein said main frame portion also supports said stock feed means and said tube former.

22. The packaging machine of claim 21, wherein:

(a) said packaging stock is flat non-tubular material;

(b) sad tube former when coacting with the stock to form same into said tubular configuration doing so so that the longitudinal edges of the stock overlap; and (c) said package material sealing means also effecting a longitudinal seal for a predetermined extent of the overlapping edges in the longitudinal direction thereof from the seal across the width of the tube.

23. Pouch forming equipment; comprising:

(a) component support means;

(b) packaging stock support means carried by said component support means for positioning a supply of flat heat sealable film packaging stock proximate the beginning of a stock feed path;

(c) stock feed means for feeding packaging stock to and through said stock feed path;

(d) a tube former carried by said component support means proximate said stock feed path for receiving packaging stock as it moves therealong and for forming the flat stock into a tubular configuration with the longitudinally extending edges of the stock overlapping but not secured together; and (e) packaging material sealing means carried by said component support means proximate said stock feed path and for coaction with the packaging material after it has been formed into a tubular configuration by said tube former to effect a seal across the width of the tube so formed and for a predetermined extent of the overlapping edges of the packaging stock in the longitudinal direction thereof from the seal across the width of the tube to thereby form a pouch;

(f) said packaging material sealing means including an inverted substantially "T" shaped sealer disposed for coaction with the tube of packaging stock to effect the seal across the width thereof, and for the predetermined length along the longitudinal edges thereof;

(g) said substantially "T" shaped heat sealer having a longitudinally extending leg which terminates at a first end that is pivotally mounted to said component support means and at a second end that is connected to a cross-arm;

(h) said packaging material sealing means also including electrically operated solenoid means carried by said component support means and including a plunger disposed for coaction with said cross-arm and movable, upon energization of solenoid means, towards said cross-arm to coact with same in effecting said heat seal;

(i) said packaging material sealing means further including linkage means coacting with said plunger means upon said movement thereof to rock said longitudinally extending leg about said pivotal mounting thereof and to rock said cross-arm so as to move said cross-arm towards said plunger.

24. The pouch forming equipment of claim 23, wherein said packaging material sealing means also includes electromagnet means disposed for coaction with said cross-arm and energizable upon movement of said cross-arm towards said plunger to further draw said cross-arm said packing material when sealing same.

25. A packaging machine; comprising:

(a) support means;

(b) packaging stock supply positioning means for positioning a supply of packaging stock proximate said support means;

(c) pouch positioning means carried by said support means for positioning at least a portion of the packaging stock so that a pouch carried proximate an end of the supply of packaging stock is in position to have material to be packaged placed therewithin;

(d) fulcrum means mounting said support means, and said pouch positioning means, for movement about a predetermined axis of rotation and in a predetermined direction upon entry of material into a pouch;

(e) material responsive means disposed for coaction with said support means when said support means moves in said predetermined direction about said predetermined axis of rotation as material enters a pouch;

(f) said material responsive means providing a signal indicative of the amount of material that has been deposited in the pouch.

26. The packaging machine of claim 25, including material directing means carried by said support means for directing material to be packaged into a pouch.

27. The packaging machine of claim 26, wherein said material responsive coacts with said material directing means to arrest the flow of material when a desired amount of material has been deposited in a pouch.

28. The packaging machine of claim 27 including selectively settable means coacting with said material responsive means and selectively settable to a plurality of desired amounts of material.

29. The packaging machine of claim 28:

(a) wherein said material responsive means includes electrical means disposed for coaction with said support means;

(b) control and circuit means interconnecting said selectively settable means and said material responsive means into an integrated and co-ordinated system;

(c) said material responsive means providing an output signal to arrest flow of material to said material directing means upon sensing that the selectively set amount of material has been deposited in the pouch.

30. The packaging machine of claim 29 including pouch forming means coacting with the packaging stock to form pouches thereon.

31. The packaging machine of claim 30 wherein said pouch forming means includes heat sealing means providing a seal at least across the width of the packing stock proximate said pouch positioning means to provide a pouch at the end of the packaging stock.

32. The packaging machine of claim 31 wherein said heat sealing means provides a seal across the width of the stock and for a predetermined extent of its length from said seal across the width to provide a pouch at the end of the packaging stock.

33. The packaging machine of claim 29 wherein said electrical means includes a load cell.

* * * * *